US007198080B2

(12) United States Patent
Foust

(10) Patent No.: US 7,198,080 B2
(45) Date of Patent: Apr. 3, 2007

(54) MATING FUNNEL ASSEMBLY FOR LINKING ADJACENT BOTTLES

(76) Inventor: P. William Foust, 510 Pine St., Camden, SC (US) 29020

( * ) Notice: Subject to any disclaimer, the term of this patent is extended or adjusted under 35 U.S.C. 154(b) by 137 days.

(21) Appl. No.: 11/084,185

(22) Filed: Mar. 21, 2005

(65) Prior Publication Data

US 2005/0205159 A1 Sep. 22, 2005

Related U.S. Application Data

(60) Provisional application No. 60/554,352, filed on Mar. 19, 2004.

(51) Int. Cl.
*B65B 1/04* (2006.01)

(52) U.S. Cl. ..... 141/386; 141/319; 141/383; 285/145.4

(58) Field of Classification Search ..... 141/319, 141/331–345, 383–386; 285/145.4, 146.3
See application file for complete search history.

(56) References Cited

U.S. PATENT DOCUMENTS

| | | | | |
|---|---|---|---|---|
| 2,517,759 | A | 8/1950 | Bentzen | |
| 3,261,380 | A | 7/1966 | Holleman | |
| 3,620,267 | A | 11/1971 | Seablom | |
| 3,945,617 | A | 3/1976 | Callery | |
| 4,347,879 | A | 9/1982 | Blaser | |
| 5,642,763 | A | 7/1997 | Kurtz | |
| 5,655,580 | A | 8/1997 | Schrock | |
| 5,884,678 | A | 3/1999 | Chudy | |
| 5,964,260 | A | 10/1999 | Chudy | |
| 6,182,720 | B1 | 2/2001 | Barnoski et al. | |
| 6,397,907 | B1 * | 6/2002 | Heintz | 141/338 |
| 6,568,440 | B1 | 5/2003 | Engelbrecht | |
| 2003/0010400 | A1 | 1/2003 | Varga | |

* cited by examiner

*Primary Examiner*—Timothy L. Maust
(74) *Attorney, Agent, or Firm*—Welsh & Flaxman LLC

(57) ABSTRACT

A mating funnel assembly for linking adjacent bottles includes a series of clamping members shaped and adapted for selectively linking adjacent bottles together, the series of clamping members being formed with different diameters. Each clamping member includes first and second semi-circular clamping elements. The first clamping element includes a first end and a second end and the second clamping element similarly includes a first end and a second end. The second ends of the first and second clamping elements are coupled creating a hinge allowing the first and second clamping elements to pivot relative to one another. The first ends of the first and second clamping elements are respectively provided with coupling members.

11 Claims, 3 Drawing Sheets

MATING FUNNEL ASSEMBLY FOR LINKING ADJACENT BOTTLES

CROSS REFERENCE TO RELATED APPLICATIONS

This application is based upon U.S. Provisional Patent Application Ser. No. 60,554,352, filed Mar. 19, 2004, entitled "MATING FUNNEL ASSEMBLY FOR LINKING ADJACENT BOTTLES"

BACKGROUND OF THE INVENTION

1. Field of the Invention

The invention relates to a funnel assembly for linking adjacent bottles. More particularly, the invention relates to an adjustable mating funnel assembly composed of a plurality of clamping members adapted for selectively coupling the openings of adjacent bottles regardless of the opening size of the adjacent bottles.

2. Description of the Prior Art

The restaurant industry, and some homeowners, have made it a common practice to pour the contents of a partially full bottle into a second dispensing bottle so that the dispensing bottle is always relatively full when used. The process is used for consolidating the material held in the bottles. It is also often desirable to refill a serving bottle from a large storage bottle so as to avoid the cost of constantly replacing the serving bottles.

This practice of pouring the contents of one bottle to a second bottle is commonly referred to as "mating" and is accomplished though the use of a steady hand pouring the contents from one bottle to another, a funnel directing the contents between bottles, or a coupling structure linking adjacent bottles for controlled passage of their contents.

With this in mind, a variety of devices have been developed for facilitating the transfer of the contents of one bottle to another. Many of these devices require that one bottle be attached to another bottle, for example, via a connecting device with threading designed to engage the bottles for mating. However, the prior art devices do not readily allow for the transfer of material from bottles having different shaped and sized openings and necks. The prior art devices are generally designed for specific containers and must, therefore, be used with bottles having specific threading and diameters.

With this in mind, a need exists for a universal funnel assembly allowing for the "mating" of various bottles regardless of the shape, size or thread configuration (or lack thereof). The present invention provides such a funnel assembly.

SUMMARY OF THE INVENTION

Figure 1:
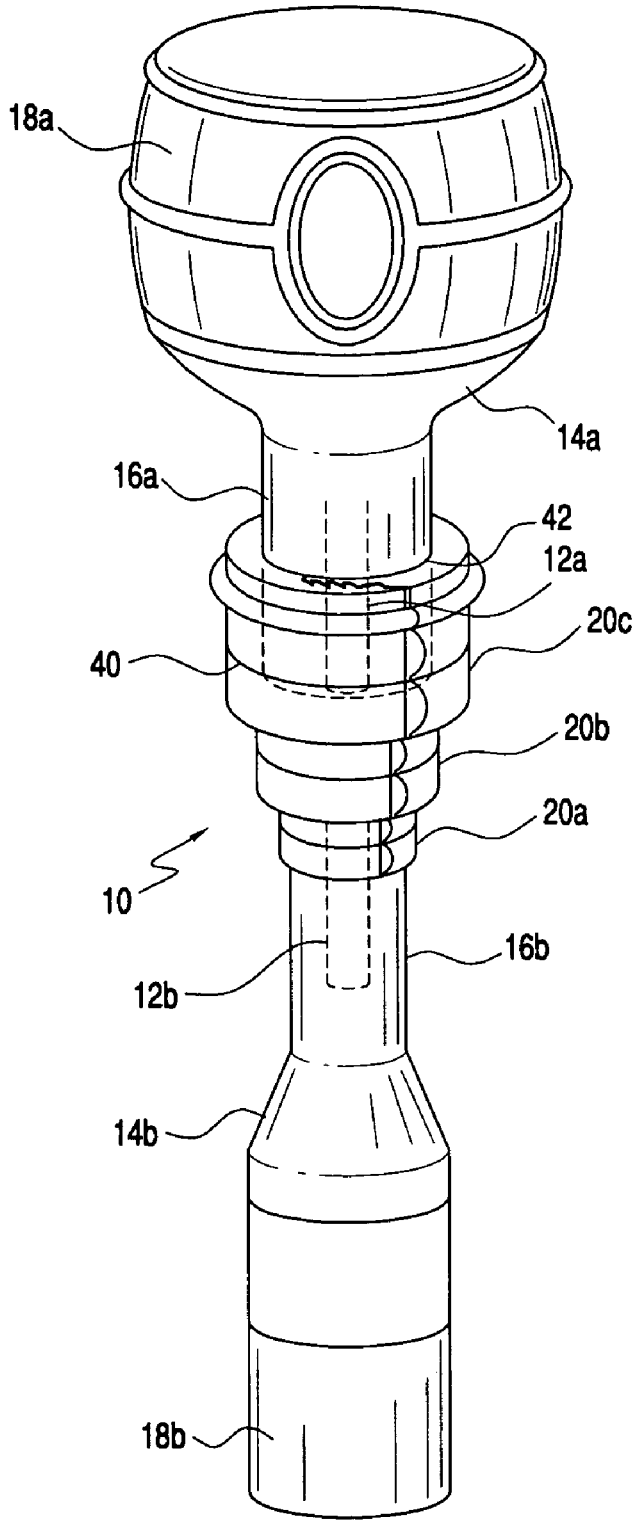
FIG. 1 is a perspective view of the mating funnel assembly in accordance with the present invention.

It is, therefore, an object of the present invention to provide a mating funnel assembly for linking adjacent bottles. The funnel assembly includes a series of clamping members shaped and adapted for selectively linking adjacent bottles together, the series of clamping members being formed with different diameters. Each clamping member includes first and second semi-circular clamping elements. The first clamping element includes a first end and a second end and the second clamping element similarly includes a first end and a second end. The second ends of the first and second clamping elements are coupled creating a hinge allowing the first and second clamping elements to pivot relative to one another. The first ends of the first and second clamping elements are respectively provided with coupling members.

It is also another object of the present invention to provide a funnel assembly having a resilient inner surface extending beyond an outer shell along an upper end and a lower end of the clamping member to improve contact with the bottles.

It is yet another object of the present invention to provide a funnel assembly wherein the various diameters are selected so as to create a stepwise progression when the clamping members are secured together to create a mating funnel assembly for adjoining bottles having openings with different diameters.

It is still another object of the present invention to provide a funnel assembly wherein the second ends of the first and second clamping elements are integrally formed creating a living hinge which links the first and second clamping elements.

It is also an object of the present invention to provide a funnel assembly wherein the coupling members at the first ends of the respective first and second clamping elements include mating teeth shaped and dimensioned for selectively locking the first ends of the first and second clamping elements together for selectively closing the clamping member in a closed configuration.

It is another object of the present invention to provide a funnel assembly including a series of funnel members shaped and adapted for selectively linking together adjacent bottles, the series of funnel members being formed with different diameters. Each funnel member including an inwardly facing coupling ring and an outwardly facing coupling ring, the inwardly facing coupling ring and the outwardly facing coupling ring being shaped and dimensioned for selective engagement with another funnel member to facilitate coupling of funnel members to one another.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

Figure 2:
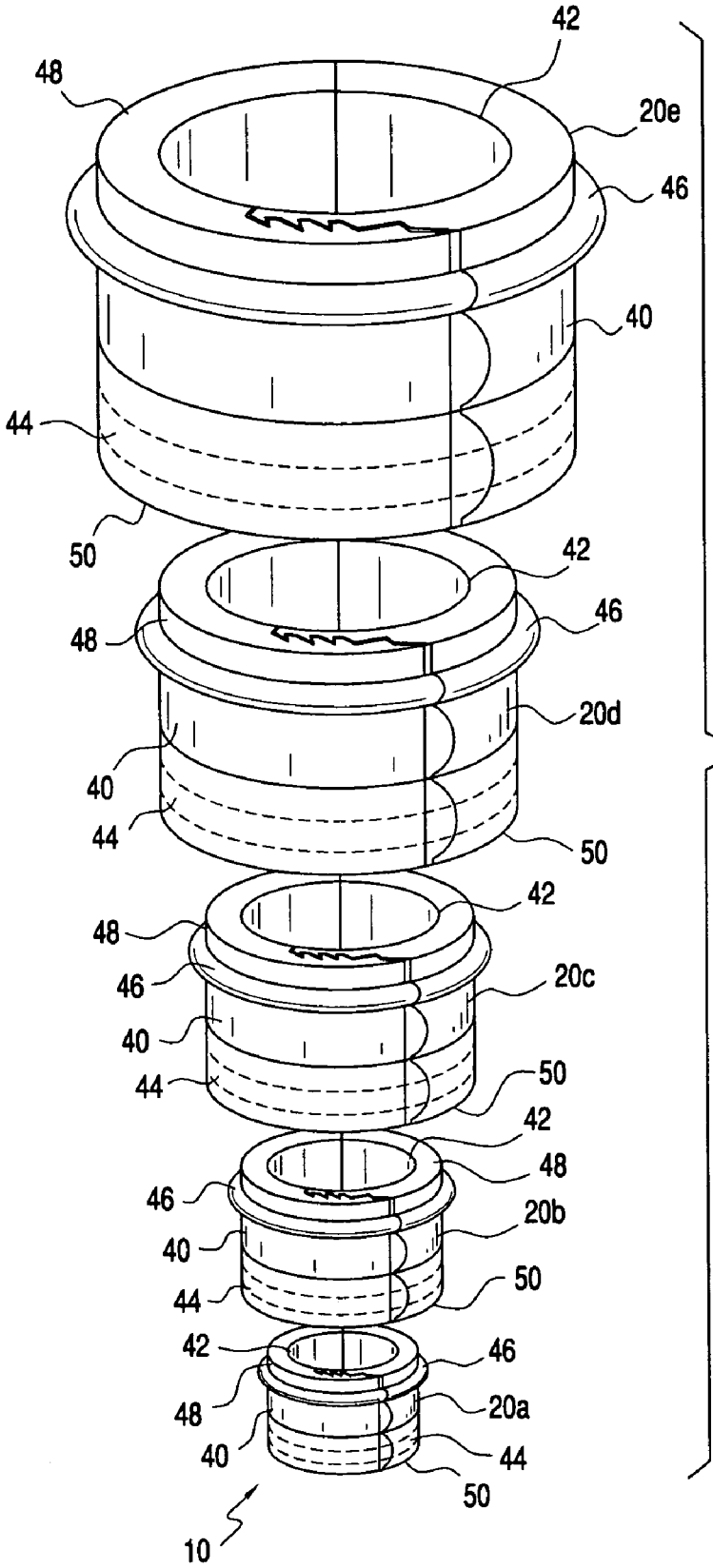
FIG. 2 is a perspective view of a series of clamping members.
Figure 3:
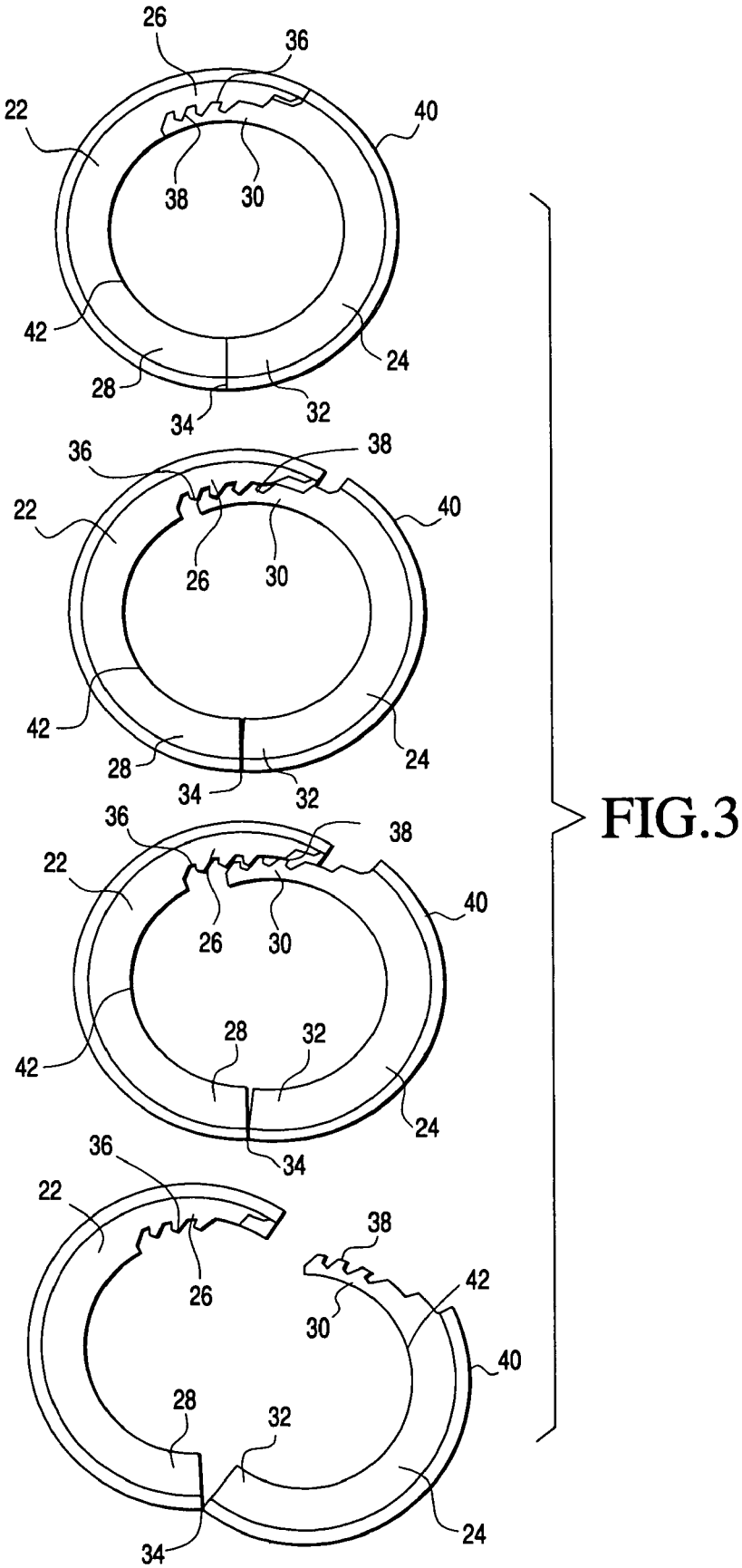
FIG. 3 is a series of top views of a clamping member showing it moving from a closed clamping orientation to an open orientation.

With reference to FIGS. 1, 2 and 3, a mating funnel assembly 10 is disclosed for linking the openings 12*a*, 12*b* of adjacent bottles 14*a*, 14*b* regardless of the size of the bottle necks 16*a*, 16*b*. As those skilled in the art will certainly appreciate, the term "bottle" is used throughout the body of the present disclosure to describe the receptacles that are linked to permit the ready transfer of material from a dispensing receptacle to a receiving receptacle. As such, the term "bottle" should not be construed as limiting the receptacles to any specific shape or material construction, but is rather used as a common term that should be readily understood by those skilled in the art.

The present mating funnel assembly 10 facilitates the coupling of adjacent bottles 14*a*, 14*b* for the ready transfer of material from a dispensing bottle 14*a* to a receiving bottle 14*b*. For the purposes of the present disclosure, each bottle 14*a*, 14*b* includes a reservoir 18*a*, 18*b*, a neck 16*a*, 16*b* and an opening 12*a*, 12*b* at the distal end of the neck 16*a*, 16*b*. The material contained within the dispensing bottle 14*a* is stored within the receptacle 18*a* until such time that an individual wishes to pour it from the dispensing bottle 14*a* to the receiving bottle 14*b*. At that time, the dispensing bottle 14*a* is aligned with the receiving bottle 14*b*. The bottles 14*a*, 14*b* are then aligned and tilted such that the material flows down the neck 16*a* and out the opening 12*a* of the dispensing bottle 14*a* and into the opening 12*b* and down the neck 16*b* of the receiving bottle 14*b*.

The present mating funnel assembly 10 permits an individual to link the openings 12*a*, 12*b* of adjacent bottles 14*a*, 14*b* so that the material within a dispensing bottle 14*a* may be easily poured into the receiving bottle 14*b*. The mating funnel assembly 10 includes a series of clamping members 20*a–e* shaped and adapted for selective linking. The series of clamping members 20*a–e* are formed with different diameters. The various diameters are selected so as to create a stepwise progression when the clamping members 20*a–e* are secured together to create a mating funnel assembly 10 for adjoining bottles 14*a*, 14*b* having openings and/or necks with different diameters. As such, and as will be appreciated based upon the following disclosure, clamping members 20*a–e* sized for the dispensing and receiving bottles 14*a*, 14*b* are selected and the mating funnel assembly 10 is constructed with the chosen clamping members 20*a–e* positioned at the top and bottom of the mating funnel assembly 10.

More specifically, and with regard to the clamping members 20*a–e*, each clamping member 20*a–e* includes first and second semi-circular clamping elements 22, 24. The first clamping element 22 includes a first end 26 and a second end 28 and the second clamping element 24 similarly includes a first end 30 and a second end 32. The second ends 28, 32 of the first and second clamping elements 22, 24 are coupled creating a hinge 34 allowing the first and second clamping elements 22, 24 to pivot relative to one another. In accordance with a preferred embodiment of the present invention, the second ends 28, 32 of the first and second clamping elements 22, 24 are integrally formed creating a living hinge 34 which links the first and second clamping elements 22, 24.

The first ends 26, 30 of the first and second clamping elements 22, 24 are provided with mating teeth 36, 38 shaped and dimensioned for selectively locking the first ends 26, 30 of the first and second clamping elements 22, 24 together for closing the clamping members 20*a–e* in a closed configuration. As will be appreciated based upon the following discussing, the mating teeth 36, 38 of the first ends 26, 30 of the first and second clamping elements 22, 24 permit locking at different positions allowing the clamping members 20*a–e* to be locked about bottle necks 16*a*, 16*b* having different neck diameters.

In accordance with a preferred embodiment of the present invention, each clamping member 20*a–e* is formed from a resilient plastic. The clamping member 20*a–e* includes an outer shell 40 having a resilient inner surface 42, adapted for engaging and conforming to the outer surface of the bottle neck 16*a*, 16*b*. The outer shell 40 having an upper end 48 and a lower end 50 spaced a distance from one another so as to accommodate inwardly and outwardly facing coupling rings 44, 46. As those skilled in the art will certainly appreciate, preferred materials are disclosed herein although the materials may be varied to suit specific needs without departing from the spirit of the present invention.

As briefly discussed above, the various clamping members 20*a–e* are shaped and dimensioned for selective engagement with a clamping member 20*a–e* of a size one step smaller or one step larger. For example, wherein five clamping members 20*a–e* are provided, clamping member 20*a* will sit within clamping member 20*b*, clamping member 20*b* will sit within clamping member 20*c*, clamping member 20*c* will sit within clamping member 20*d* and clamping member 20*d* will sit within clamping member 20*e*. The number and order of the clamping members 20*a–e* used in accordance with the present invention will vary depending on the bottle neck 16*a*, 16*b* sizes to be linked.

The clamping members 20*a–e* are held together by the provision of inwardly and outwardly facing coupling rings 44, 46 respectively formed along the inner and outer surfaces of the various clamping members 20*a–e*. Specifically, each clamping member 20*a–e* includes an upper end 48 and a lower end 50. The outwardly facing coupling ring 46 is provided adjacent the upper end 48 of the clamping members 20*a–e*. The inwardly facing coupling ring 44 is actually a recess shaped and dimensioned to receive the outwardly facing coupling ring 46. The inwardly facing coupling ring 44 is formed adjacent the lower end 50 of the clamping members 20*a–e*.

In practice, a user will select a clamping member 20*a–e* of a size to fit about the neck 16*b* of the smaller bottle neck diameter and secure the clamping member 20*a–e* about the bottle neck 16*b*. Thereafter, the user will select a clamping member 20*a–e* of a size to fit about the neck 16*a* of the larger bottle neck diameter. The user will then successively attach the clamping members 20*a–e* until the large diameter clamping member is ready for attachment to the large diameter bottle neck. For example, if the user found it was necessary to use clamping member 20*a* and clamping member 20*c* for the bottles 14*a*, 14*b* to be mated, the user would secure clamping member 20*a* to the small diameter bottle neck 16*b*, secure clamping member 20*b* to clamping member 20*a* such that clamping member 20*a* sits within clamping member 20*b* and the outwardly facing coupling ring 45 seats with the inwardly facing coupling ring 44, secure clamping member 20*c* to clamping member 20*b* in a similar manner and invert the larger bottle 14*a* into the upper end 48 of clamping member 20*c* to pour contents thereof into the small neck bottle 14*b*.

As those skilled in the art will certainly appreciate, the steps may be substantially reversed where a user wishes to pour material from a small neck diameter bottle to a large neck diameter bottle. Similarly, if the bottle necks are of substantially the same diameter, the user need only clamp the selected clamping member onto the receiving bottle and invert the dispensing bottles onto the upper end of the clamping member.

As those skilled in the art will appreciate, the resilient material used in constructing the clamping members 20*a–e* provides an ideal surface for seating and retaining of the dispensing bottle 14*a* when it is inverted and placed within the present mating funnel assembly 10. In fact, the present invention is design to permit the dispensing bottle 14*a* to sit above the receiving bottle 14*b* without support by the user, since the center of gravity of the dispensing bottle will be centered over the receiving bottle.

While the preferred embodiments have been shown and described, it will be understood that there is no intent to limit the invention by such disclosure, but rather, is intended to cover all modifications and alternate constructions falling within the spirit and scope of the invention as defined in the appended claims.

The invention claimed is:

1. A mating funnel assembly for linking adjacent bottles, comprising:

a series of clamping members shaped and adapted for selectively linking adjacent bottles together, the series of clamping members being formed with different diameters;

each clamping member includes first and second semi-circular clamping elements, the first clamping element includes a first end and a second end and the second clamping element similarly includes a first end and a second end;

the second ends of the first and second clamping elements are coupled creating a hinge allowing the first and second clamping elements to pivot relative to one another;

the first ends of the first and second clamping elements are respectively provided with coupling members.

2. The funnel assembly according to claim 1, wherein the clamping member are formed from a resilient plastic material.

3. The funnel assembly according to claim 2, wherein the clamping members are formed by an injection molding process.

4. The funnel assembly according to claim 2, wherein the clamping member includes an outer shell with a resilient inner surface.

5. The funnel assembly according to claim 1, wherein the various diameters are selected so as to create a step wise progression when the clamping members are secured together to create a mating funnel assembly for adjoining bottles having necks with different diameters.

6. The funnel assembly according to claim 1, wherein the second ends of the first and second clamping elements are integrally formed creating a living hinge which links the first and second clamping elements.

7. The funnel assembly according to claim 1, wherein the coupling members at the first ends of the respective first and second clamping elements include mating teeth shaped and dimensioned for selectively locking the first ends of the first and second clamping elements together for selectively closing the clamping member in a closed configuration.

8. A mating funnel assembly for linking adjacent bottles, comprising:

a senes of funnel members shaped and adapted for selectively linking together adjacent bottles, the series of funnel members being formed with different diameters;

each funnel member including an inwardly facing coupling ring and an outwardly facing coupling ring, the inwardly facing coupling ring and the outwardly facing coupling ring being shaped and dimensioned for selective engagement with another funnel member to facilitate coupling thereof; and wherein at least one funnel member includes first and second semi-circular clamping elements,the first clamping element includes a first end and a second end and the second clamping element similarly includes a first end and a second end; the second ends of the first and second clamping elements are coupled creating a hinge allowing the first and second clamping elements to pivot relative to one another; the first ends of the first and second clamping elements are provided with coupling members.

9. The funnel assembly according to claim 8, wherein the outwardly facing coupling ring is formed along the outer surface of each funnel member and the inwardly facing coupling ring is formed along the inner surface of each funnel member.

10. The funnel assembly according to claim 8, wherein the coupling members at the first ends of the respective first and second clamping elements include mating teeth shaped and dimensioned for selectively locking the first ends of the first and second clamping elements together for selectively closing the clamping member in a closed configuration.

11. The funnel assembly according to claim 8, wherein the various diameters are selected so as to create a step wise progression when the funnel members are secured together to create a mating funnel assembly for adjoining bottles having openings with different diameters.

* * * * *